United States Patent [19]

Dholoo

[11] Patent Number: 4,815,986

[45] Date of Patent: Mar. 28, 1989

[54] SELF-ALIGNING BLIND MATE CONNECTOR

[75] Inventor: Jimmy F. Dholoo, Gaithersburg, Md.

[73] Assignee: Lucas Weinschel, Inc., Gaithersburg, Md.

[21] Appl. No.: 180,761

[22] Filed: Apr. 12, 1988

Related U.S. Application Data

[63] Continuation-in-part of Ser. No. 85,147, Aug. 14, 1987, abandoned.

[51] Int. Cl.[4] ..... H01R 13/64

[52] U.S. Cl. ..... 439/248; 439/252

[58] Field of Search ..... 439/246–252

[56] References Cited

U.S. PATENT DOCUMENTS

| | | | |
|---|---|---|---|
| 1,531,917 | 3/1925 | French | 439/247 |
| 3,047,828 | 7/1962 | Gregson et al. | 439/248 |
| 3,056,940 | 10/1962 | Winestock | 439/252 |
| 3,088,089 | 4/1963 | Gregoire | 439/248 |
| 3,091,748 | 5/1963 | Takes et al. | 439/248 |
| 3,529,278 | 9/1970 | Bishop | 439/551 |
| 3,683,320 | 8/1972 | Woods et al. | 439/198 |
| 3,876,277 | 4/1975 | Colwell | 439/551 |
| 3,905,669 | 9/1975 | McCormick | 439/380 |
| 4,037,904 | 7/1977 | Arnold et al. | 439/248 |
| 4,043,629 | 8/1977 | Brannen | 439/564 |
| 4,066,324 | 1/1978 | Stephens | 174/153 A |
| 4,125,308 | 11/1978 | Schilling | 439/63 |
| 4,227,765 | 10/1980 | Neumann et al. | 439/248 |
| 4,333,697 | 6/1982 | Dreyer | 439/166 |
| 4,440,464 | 4/1984 | Spinner | 439/218 |
| 4,441,781 | 4/1984 | Forney et al. | 29/705 |
| 4,580,862 | 4/1986 | Johnson | 439/248 |

FOREIGN PATENT DOCUMENTS

| | | | |
|---|---|---|---|
| 2548692 | 5/1977 | Fed. Rep. of Germany | 439/252 |
| 972359 | 1/1951 | France | 439/246 |
| 1064360 | 12/1983 | U.S.S.R. . | |
| 0381178 | 9/1932 | United Kingdom | 439/252 |
| 1455182 | 11/1976 | United Kingdom | 439/248 |

*Primary Examiner*—Gary F. Paumen

*Attorney, Agent, or Firm*—Hall, Myers & Rose

[57] ABSTRACT

A self-aligning blind mate connector designed for surface mounting to existing RF coaxial pin and outer sheath ring of a sealed RF module. The two halves of the connector provide positive interlock upon engagement and allow for both axial and radial misalignment. Each half includes an inner body member housing the conductors and a body capture member to secure the inner body to the RF module while allowing for mobility of the connectors to accommodate misalignment.

14 Claims, 3 Drawing Sheets

SELF-ALIGNING BLIND MATE CONNECTOR

This is a continuation-in-part of Ser. No. 085,147, filed Aug. 14, 1987 now abandoned.

BACKGROUND OF THE INVENTION

The present invention relates to electrical connectors. More particularly, the present invention relates to electrical connectors utilized in inaccessible locations requiring self-alignment.

The need for mating connectors is well known in the electronics and electrical art. It is common to provide mating connectors wherein one or both halves of the connector are permanently mounted to a larger piece of hardware, such as a chassis, a panel or rack insert, or a component board. Often these parts will contain a number of connector halves which must be simultaneously aligned while installing and mounting the major component. Due to the size or configuration of the components, the connections often have to be made blind. When electrical connections are made blind, the connectors must be self-aligning to assure proper orientation and intimate electrical connection.

When a number of connectors are included on a single component, slight manufacturing intolerances can lead to misalignment of connectors. Therefore, it is necessary to provide a somewhat resilient connector which can accommodate minor misalignment.

A number of two-part electrical connectors have been proposed, in the prior art, which deal with certain aspects of the problems associated with the blind mating of connectors. U.S. Pat. No. 3,091,748 to Takes teaches a co-axial connector for use in rack and panel equipment. Only the plug portion of the Takes connector is spring mounted, while the receptacle portion remains rigidly mounted. U.S. Pat. No. 3,047,828 to Gregson teaches an RF connector for utilization in a plug-in subunit chassis. Gregson teaches unique mounting configurations allowing for easy connection and removal of co-axial cables.

U.S. Pat. No. 3,056,940 to Weinstock teaches a self-aligning co-axial connector which utilizes brush contacts to maintain proper electrical connection in misalignment situations. Gregoire U.S. Pat. No. 3,088,089 teaches a resilient socket connector having a unique sealing means when engaged in an operative position. McCormick, U.S. Pat. No. 3,905,669, teaches an electrical connector electro-structural coupling assembly. The structure of McCormick is utilized to interconnect a plurality of subassemblies. Soviet Patent No. SU 1,064,360A teaches an electrical coupler having both pin and socket members mounted in spring-biased cups attached to separate housings.

U.S. Pat. No. 4,227,765 to Neumann teaches the use of a metal bellows to provide an electro-magnetic radiation shield for a resiliently-mounted socket portion of a connector. The socket portion of the connector is provided with a resilient mounting to allow for axial misalignment of a pin member rigidly connected to separate major components. Johnson, U.S. Pat. No. 4,580,862, teaches the spring-biased mounting of a plug member for mating with a rigidly-mounted socket portion of an electrical connector.

None of the connectors taught in the prior art provide totally independently-alignable contacts, wherein the center and sheath conductors of a coaxial connector are independently self-aligning. The prior art does not provide a connector able to adapt to accommodate a full broad range of misalignment situations.

SUMMARY OF THE INVENTION

The present invention provides a co-axial connector having two independently-floating halves. Both the pin and socket portions of the connector are independently, axially and radially adjustable during self-alignment of the connector. Once aligned and engaged, the connector pair creates a threadless, positively-mated coupling which allows for rapid coupling and decoupling without external mechanical disengagement of the connector halves.

Each connector half is configured for mounting to one component of a system of components which are electrically interconnected through mating connector halves by positioning the contact bearing faces into proper alignment.

The positive co-locking mechanism of the present invention provides for a secure integral electrical connection while providing ease of uncoupling through the exertion of linear force.

The embodiment of the present invention utilizes plug and socket members independently connected to conductive bellows which are, in turn, electrically connected to independent component members. Outer sheath electrical continuity is maintained while providing for resilient mounting, through utilization of a plurality of spring members in the seating of the connector to the respective components.

Providing a conical opening in the floating sheath surrounding one member, the smaller diameter of the floating sheath surrounding the other member, provides self-alignment upon blind mating of the connector halves.

The present connector is provided with an outer flange member for securing each connector half to an RF module. The RF coaxial pin is accepted into one end of a conductive bellows and the flange member is secured to the panel. The internal rigid configuration of the RF module, and the component to which it is mounted, is maintained. All of the flexibility and self-alignment is therefore provided external to the component. This is important where it is desirable to maintain the internal configuration and rigidity, while providing flexible blind mating.

The present invention, therefore, provides a mechanism for converting to an improved self-aligning blind mate connector system, wherein the self-aligning blind mate connector halves are readily mounted on sealed RF subassemblies without soldering or permanently bonding the connector half to the RF circuit or to the component panel. The connectors of the present invention also eliminate the need for access to the internal portion of the component, because the connector halves of the present invention are surface-mounted, requiring a minimum number of mounting holes in the component panels, which are tapped to accommodate mounting screws and need not be through holes into the interior of the component. The configuration of the present invention eliminates the need for mounting each connector half within a cutout in the panel of the component assemblies.

Each connector half of the present invention is constructed with an integral base plate flange member providing structural rigidity to resist deformity due to stress forces caused by connector or component misalignment. The present invention, therefore, provides a reliable multiple-coupling connector for chassis and sub-chassis blind mate applications.

The connector halves of the present invention also provide the necessary ability to maintain amplitude and phase-matching, due to the nearly constant electrical length provided between connector pairs by the design and configuration of the connectors of the present invention. The provision of amplitude and phase matching is often necessary in phase-coherent systems which often utilize self-aligning blind mate connectors.

The flexible metal bellows utilized as the central conductor of the coaxial connector is sized to provide proper impedance matching with the RF pin, to which the connector is electrically attached. Because the bellows forms a non-constant diameter conductor, impedance matching must be accomplished by taking into account the effective electrical diameter of the bellows conductor based on its maximum, minimum and mean diameter.

The present invention is further described below with respect to certain embodiments, as illustrated in the following drawings.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF A PREFERRED EXEMPLARY EMBODIMENT

Figure 1:
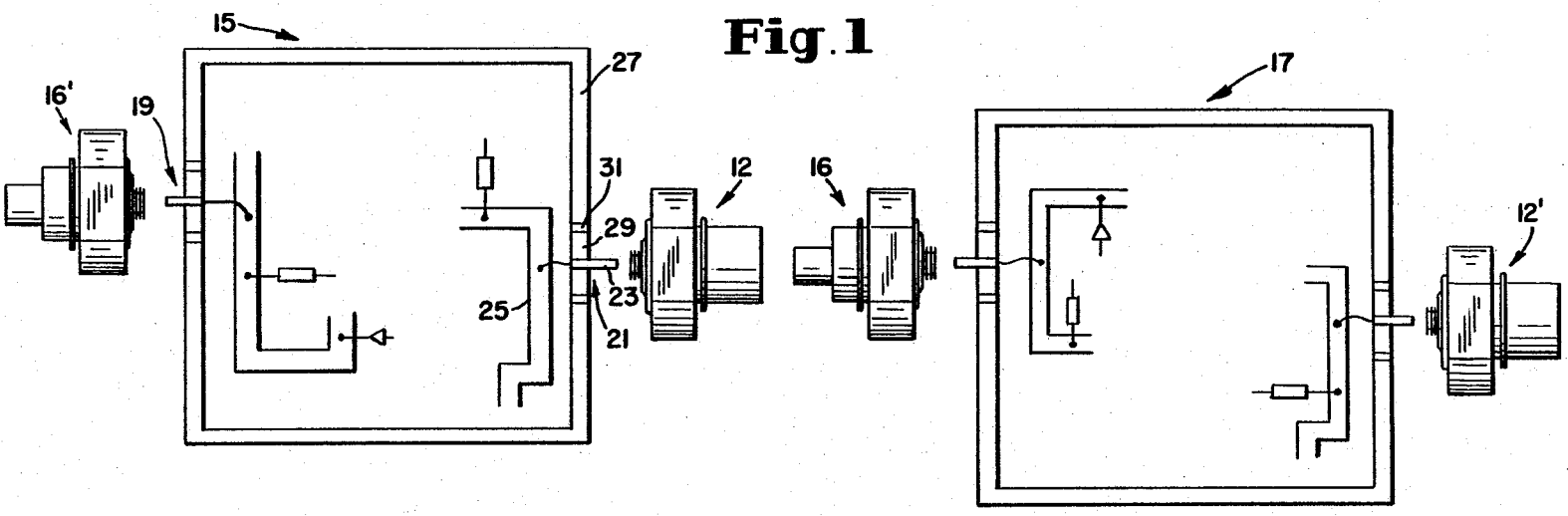
FIG. 1 is a top view illustrating the utilization of connectors of the present invention to interconnect sealed RF subassemblies.

FIG. 1 illustrates a number of connector halves, 12, 12', 16 and 16', linking component modules 15 and 17. Module 15 can be, for example, an amplifier having a first RF input 19 and an RF output 21. The center conductor 23 of RF connector 19 is electrically connected to strip line 25 within the module 15, and is insulated from the module chassis 27 by sealed glass bead 29, surrounded by RF outer conductor 31.

Outer conductor 31, glass bead 29 and center conductor 23 form a sealed RF unit which is either press fit, welded or otherwise adhered within a cutout in the module chassis 27. The module 15 thereby forms a sealed unit which provides improved reliance and performance. The connectors 12 and 16' attach directly to the chassis and accommodate the RF center conductors, thereby eliminating the need to replace existing sealed RF units 19 and 21 with special connector members.

Figure 6:
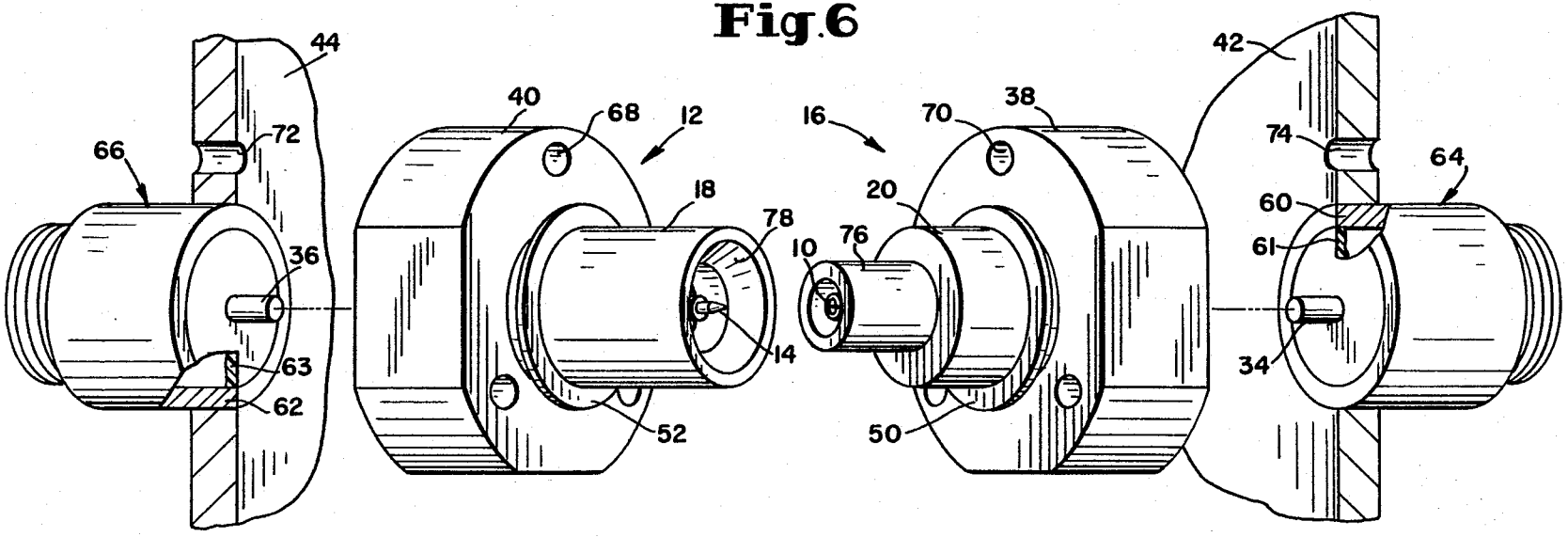
FIG. 6 is a side view illustrating the two connector halves and their mounting on existing RF pin assemblies.
Figure 7A:
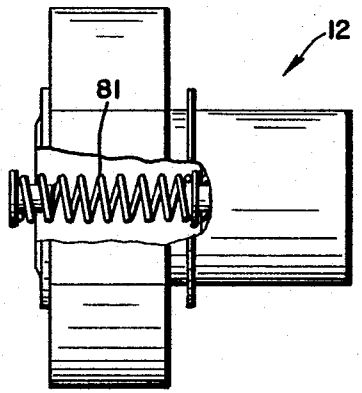
FIGS. 7A–7D are perspective views illustrating alternative embodiments of the present invention.
Figure 7B:
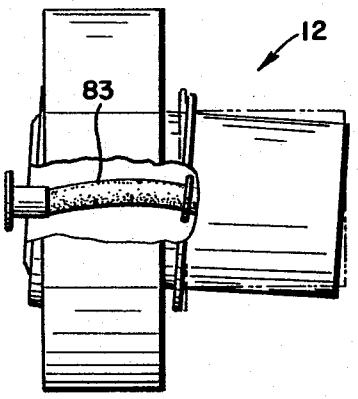
Figure 7C:
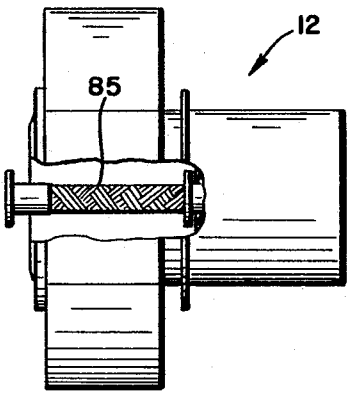
Figure 7D:
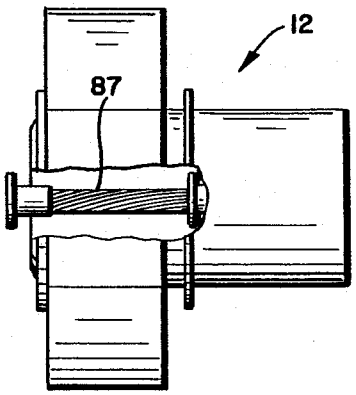

In other applications, a coaxial connector 66, as illustrated in FIG. 6, is fixedly mounted in panel member 44, as part of an overall component member. The electrical lines of connector 66 will often need to be connected to complimentary lines of a second connector. This second connector, such as connector 64, is often seated in a panel 42 of a separate component or subassembly. Either the main panel 44 or subassembly panel 42 may also contain a number of other connectors, all of which need to be simultaneously engaged upon proper orientation of the main and subcomponent panels. Coaxial connectors 64 and 66 each contain a central conductor 34 or 36 and an outer conductor 60 or 62 separated by an insulator member 61 or 63.

If a standard rigid connector is utilized between connectors 66 and 64, the precise alignment of panels 42 and 44 is required in order to achieve and maintain electrical continuity between the connectors. Alignment of connectors is often obscured by the panels themselves which block access to and observation of the connectors as they are engaged. Through the utilization of the self-aligning blind-mating connector, as taught herein, it is possible to achieve both self-alignment and the necessary electrical connections desired, even in blind-mating and misaligned situations.

The present connector halves 12 and 16 are mounted to panel members 44 and 42 by securing base members 40 and 38 to panel numbers 44 and 42, respectively. Base members 40 and 38 can be secured by bolts inserted through holes 68 and 70, and threaded into holes 72 and 74. Other means can be utilized to secure base plates 40 and 38 to panel members 44 and 42, so long as the base members are maintained in a fixed relation to panel numbers.

As illustrated in FIG. 6, the present invention provides a two-part connector having a central conductor and a coaxial outer sheath conductor. At the juncture of the two connector halves the center conductor is carried by a socket portion 10 on the first connector half 12 and by a pin 14 on the second connector half 16. Upon engagement of the two connector halves, electrical continuity of the outer connector is established through contact of outer guide member 18 and alignment insert member 20.

Figure 2:
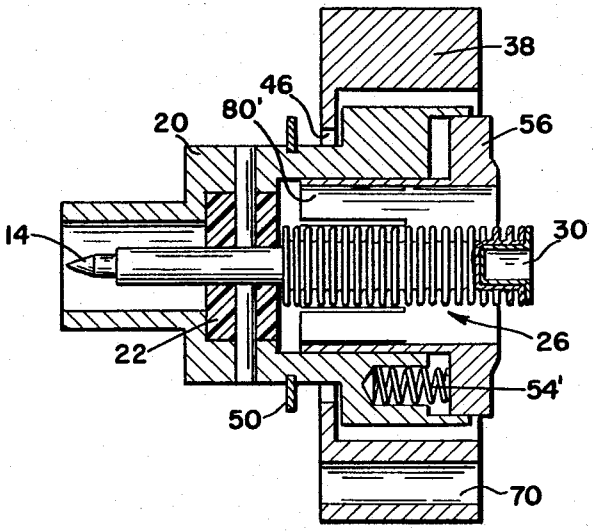
FIG. 2 is a detailed cutaway view of the pin half of the connector assembly.
Figure 3:
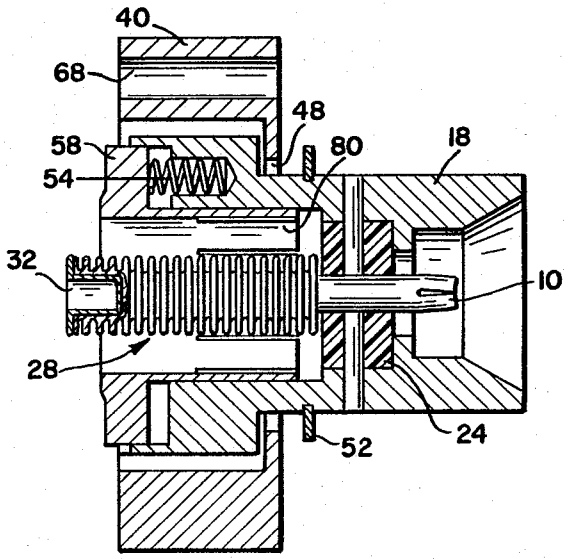
FIG. 3 is a detailed cutaway side view of the socket half of the connector assembly.

As illustrated in FIGS. 2 and 3, (wherein the pin and socket are illustrated in alternate arrangement) pin member 14 and socket member 10 are electrically isolated from their respective outer conductor members 20 and 18 by dielectric plugs 22 and 24, respectively. As further illustrated in FIGS. 2 and 3, pin member 14 and socket member 10 are in electrical contact with metal bellows 26 and 28, respectively. Metal bellows 26 and 28 are provided with inserts 30 and 32, having central bores therein for receipt of pins 34 and 36, respectively, as illustrated in FIGS. 1 and 6.

Pins 34 and 36 are maintained in electrical contact with inserts 30 and 32 through the bolting of baseplates 38 and 40 to panel members 42 and 44, respectively.

Figure 5:
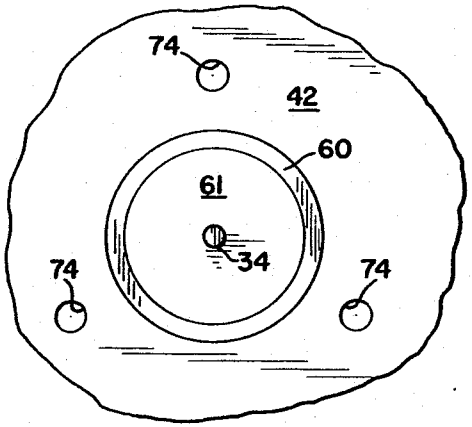
FIG. 5 is a face view of a typical RF pin connector mounted on a subcomponent chassis panel.
Figure 4:
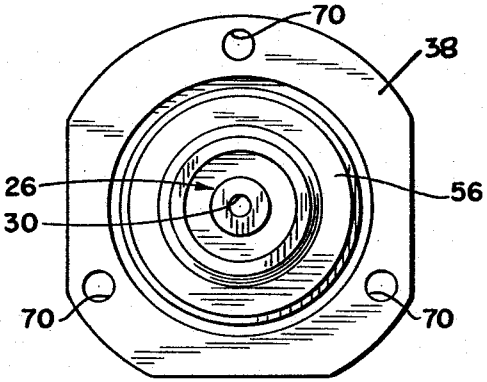
FIG. 4 is a backend view of one connector half illustrating the contact surfaces thereon.

The back face of member 16, as illustrated in FIG. 4, mates with the face of panel 42, illustrated in FIG. 5. RF tab 34 mates with central bore 30 of insert 26, and outer contact 56 is in electrical contact with contact surface 60 upon engagement of the respective faces.

Body members 18 and 20 remain free-floating to a limited extent, upon bolting of base members of 38 and 40. Clearance holes 46 and 48 in base members 38 and 40, respectively, allow for radial movement of body members 18 and 20, due to the clearance provided around the central portion of body members 18 and 20, because holes 46 and 48 are of greater diameter than the exterior diameter of the central portion of body members 18 and 20. The ledge formed by the larger diameter of the back end of the body portions, along with retaining rings 50 and 52, captivate the body members 18 and 20 within the base members 38 and 40 and also allow axial movement of members 18 and 20 relative to the base members 38 and 40. Spring tabs 80, 80' are utilized to maintain electrical continuity between insert members 56 and 58 and body members 20 and 18, contact respectively. Spring members 54, 54' allow for axial movement of body members 18 and 20, while maintaining the proper mechanical bias to provide the necessary mating forces during connector engagement.

Contact carrying body insert members 56 and 58 are held secured to body members 20 and 18, respectively, through the flared upper portion tabs 80, 80' of the contact carrying members which creates an outwardly-biasing force to hold members 56 and 58 frictionally-engaged to the interior surface of body members 20 and 18.

After base members 38 and 40 are secured to panels 42 and 44, and metal bellows 26 and 28 are engaged on center conductors 34 and 36, the connector is ready for self-alignment and blind engagement upon moving panels 42 and 44 into their appropriative relative orientations. As connector members 12 and 16 are moved laterally into engagement, the alignment insert end 76 of body member 20 will be guided by tapered guide hole 78 in the end of body member 18 to properly orient plug member 14 and socket member 10. Body members 18 and 20 of connector halves 12 and 16 will be radially deflected to allow for proper engagement of plug 14 within socket 10. Proper alignment is achievable through spring mounting 54, 54' of bodies 18 and 20, and through utilization of metal bellows members 26 and 28.

Metal bellows members 26 and 28 allow for axial and radial deflection while maintaining electrical continuity. As illustrated in FIGS. 7A–7D, the present invention can alternatively employ any of a variety of flexible electrical connectors such as a spring 81 FIG. 7A, a flexible wire 83 FIG. 7B, a braided wire 85 FIG. 7C or a strand wire 87 FIG. 7D. Further, flexible conductive elastomers can be employed as can any material which will maintain good electrical continuity while providing flexibility.

Once each of the connector halves 12 and 16 have been installed on the respective panels 44 and 42, and end 76 of member 16 has been inserted into opening 78 of member 12, thereby engaging pin 14 in socket 10, continuous coaxial electrical continuity is established. The central conductor electrical path runs from pin 36 through metal bellows 28 to socket member 10 through pin to bellows 26 and to pin 34. The outer coaxial sheath electrical path is established from outer contact 62 to spring-mounted body insert 58 which maintains electrical contact to body member 18 through biased leaf portions of insert 58 which contact the inner surface of body member 18. Body member 18 is in turn in electrical contact with body member 20 which maintains contact with body insert 56 through the biased leaf portions of spring member 56. The outer sheath conductor path is then completed by contact of member 56 with contact sheath member 60.

Continuous ground contact is maintained between the connector half and the ground ring 60 in a completely surrounding circle even during misalignment of connectors. Maintenance of the continuous ground contact is critical and is maintained by the spring biased structure of the present invention.

Once given the above disclosure, many other features, modifications and improvements will become apparent to the skilled artisan. Such features, modifications and improvements are thus to be considered a part of this invention, the scope of which is to be determined by the following claims:

I claim:

1. A connector assembly comprising;

a first body portion having a first end, a second end, and a tapered opening in said first end, a second body portion having a first end and a second end, wherein said first end is comprised of an elongated protrusion adapted for engagement in said tapered opening of said first body portion, wherein each of said body portions is of stepped cylindrical configuration, thereby forming a first radial ledge between said first and second ends, a radial protrusions extending outwardly from each of said body portions, axially spaced a set distance from said radial ledge, an electrically conductive pin member, an electrically conductive socket member adapted for receipt of said pin member, one of said members located centrally within said tapered opening and the other of said members centrally located within said elongated protrusion, first and second flexible electrically conductive bellows extending from said pin member and said socket member to the second end of its said body portion, respectively, terminating in an electrically conductive contact portion of said flexible electrically conductive bellows, first and second insert members adapted for electrical contact with said first and second body portions, respectively, first spring means resiliently mounting said first insert member to said first body portion, second spring means resiliently mounting said second insert member to a said second body portion, and first and second body capture means surrounding said second end of each of said first and second body portions, said capture means having an inwardly projecting lip limiting movement of said body portion relative to said capture means through interposition of said inward lip of said capture means between said first ledge and said radial protrusion, whereby said bellows and said spring means allow compensation for misalignment between said socket member and said pin member as they are being mated.

2. A connector assembly as in claim 1, wherein;

said pin is centrally located in said second body portion, and said socket is centrally located in said first body portion.

3. A connector comprising:

a body having a first end, a second end, and a tapered opening in said first end, wherein;

said body portion is of stepped cylindrical configuration, thereby forming a radial ledge between said first and said second ends, a radial protrusion extending outwardly from said body axially spaced a set distance from said radial ledge, an electrically conductive socket member centrally located within said opening of said body, a flexible electrically conductive bellows extending from said socket member to the second end of said body, terminating in an electrically conductive contact, an insert member adapted for electrical contact with said body, spring means resiliently mounted between said insert member and said body, body capture means surrounding said second end of said body, said capture means having an inwardly projecting lip limiting movement of said body relative to said capture means through interposition of said inward lip of said capture means between said ledge and said radial protrusion.

4. A connector comprising;

a body having a first end and a second end wherein said first end is comprised of an elongated protrusion, wherein:

said body is of stepped cylindrical configuration, thereby forming a first radial ledge between said first and said second ends, a radial protrusions extending outwardly from said body axially spaced a set distance from said radial ledge, an electrically conductive socket member, centrally located within said protrusion of said body, a flexible electrically conductive bellows extending from said socket member to the second end of said body, terminating in an electrically conductive contact, an insert member adapted for electrical contact with said body, spring means resiliently mounting said insert member to said body, body capture means surrounding said second end of said body, said capture means having an inwardly projecting lip limiting movement of said body relative to said capture means through interposition of said inward lip of said capture means between said ledge and said radial protrusion whereby said bellows and said spring means allow compensation for misalignment between said pin member and a socket member to which said pin member is to be mated.

5. A connector as in claim 4, wherein;

said socket member is replaced by an electrically conductive pin member centrally located within said first end of said body.

6. A connector assembly comprising;

a first body portion having a first end, a second end, and an exterior annular recess, a second body portion having a first end, a second end and an exterior annular recess, an electrically conductive socket member located within said first body portion, proximate said first end, an electrically conductive pin member adapted for receipt in said socket member, located within said second body portion, proximate said first end, first and second flexible electrically conductive connector means extending from said pin member and said socket member toward the second end of said first and second body portions, respectively, terminating in an electrically conductive contact portion of said flexible conductive means, first and second body capture means surrounding said second end of each of said first and second body portions, each said capture means having an inwardly projecting lip limiting movement of its respective body portion relative to said capture means through interaction of said inward lip of said capture means and said annular recess, whereby said flexible connector means allow compensation for misalignment between said socket member and said pin member.

7. A connector assembly as in claim 6, wherein;

said socket is electrically isolated from said first body portion, and said pin is electrically isolated from said second body portion.

8. A connector assembly as in claim 6, further comprising;

first and second insert members adapted for electrical contact with said first and second body portions, respectively, first spring means positioned between said first insert member and said first body portion, second spring means positioned between said second insert member and said second body portion, and an external contact ring on each of said insert members, whereby said spring means maintain electrical continuity between each of said contact rings and a corresponding said body portion.

9. The connector assembly of claim 8, wherein;

said first and said second insert members are adapted for insertion into said second end of said first and second body portions, respectively, so that said contact ring substantially surrounds said contact portion of said flexible means.

10. A connector comprising;

a body portion having a first end, a second end, and an exterior annular recess, an electrically conductive central conductor located within said body portion, proximate said first end, flexible electrically conductive connector means extending from said central conductor toward said second end of said body portion, terminating in an electrically conductive contact portion of said flexible conductive means, body capture means surrounding said second end of said body portion, said capture means having an inwardly projecting lip limiting movement of said body portion relative to said capture means through interaction of said inward lip of said capture means and said annular recess.

11. A connector as in claim 10, wherein; said central conductor is electrically isolated from said body portion.

12. A connector as in claim 10, further comprising;

an insert member adapted for electrical contact with said body portion, spring means positioned between said insert member and said body portion, and an external contact ring on said insert member, whereby said spring means maintains electrical continuity between said contact ring and said body portion.

13. The connector of claim 12, wherein;

said insert member is adapted for insertion into said second end of said body portion, so that said contact ring substantially surrounds said contact portion of said flexible means.

14. A connector comprising;

a body portion having a first end and a second end, an electrically conductive central conductor located within said body portion, proximate said first end, flexible electrically conductive connector means extending from said central conductor toward said second end of said body portion, terminating in an electrically conductive contact portion of said flexible conductive means, a body support means supporting said body portion for axial movement relative thereto, and body biasing means for biasing said body portion relative to said body support means.

* * * * *

UNITED STATES PATENT AND TRADEMARK OFFICE

CERTIFICATE OF CORRECTION

PATENT NO. : 4,815,986

DATED : March 28, 1989

INVENTOR(S) : Jimmy F. Dholoo

It is certified that error appears in the above-identified patent and that said Letters Patent is hereby corrected as shown below:

Column 4, line 37, change "first" to --second-- and "12" to --16--;
line 38, change "second" to --first-- and "16" to --12--.
Column 5, line 52, after "path" insert --in Figs. 2 and 3--.

Signed and Sealed this

Third Day of July, 1990

*Attest:*

*Attesting Officer*

HARRY F. MANBECK, JR.

*Commissioner of Patents and Trademarks*